US006557940B2

(12) United States Patent
Hayashi et al.

(10) Patent No.: US 6,557,940 B2
(45) Date of Patent: May 6, 2003

(54) CHAIR ASSISTING RISING MOVEMENTS

(75) Inventors: Mitsuo Hayashi, Kadoma (JP); Kazumi Okawa, Kadoma (JP); Hironobu Sakaue, Kadoma (JP)

(73) Assignee: Matsushita Electric Works, Ltd., Osaka (JP)

( * ) Notice: Subject to any disclaimer, the term of this patent is extended or adjusted under 35 U.S.C. 154(b) by 152 days.

(21) Appl. No.: 09/745,393

(22) Filed: Dec. 22, 2000

(65) Prior Publication Data

US 2001/0006300 A1 Jul. 5, 2001

(30) Foreign Application Priority Data

Dec. 22, 1999 (JP) ..... 11-365690

(51) Int. Cl.[7] ..... A47C 1/02

(52) U.S. Cl. ..... 297/330; 297/344.17; 297/DIG. 10

(58) Field of Search ..... 297/330, DIG. 10, 297/85, 423.19, 325, 316, 323, 341, 344.17

(56) References Cited

U.S. PATENT DOCUMENTS 3,138,402 A * 6/1964 Heyl, Jr. et al.
4,007,960 A * 2/1977 Gaffney
4,637,652 A * 1/1987 Bergenwall
4,852,939 A * 8/1989 Krauska
5,061,010 A * 10/1991 LaPointe
5,265,935 A * 11/1993 Geisler et al.
5,314,238 A * 5/1994 Komorowski et al.
5,651,580 A * 7/1997 LaPointe et al.
5,806,920 A * 9/1998 Blount
5,984,411 A * 11/1999 Galumbeck
5,992,931 A * 11/1999 LaPointe et al.
6,213,554 B1 * 4/2001 Marcoux et al.

* cited by examiner

*Primary Examiner*—Milton Nelson, Jr.
(74) *Attorney, Agent, or Firm*—Muramatsu & Associates

(57) ABSTRACT

A chair assists rising movement so that seating and rising can be comfortably performed with safety and comfort. The chair assisting rising movement is separated into a reclining block, a mount base block, and an intermediate base block. A backrest and the intermediate base block are pivotally supported by a first link while the mount base block and the intermediate base block are pivotally supported through a second link and a third link, provided in front and rear. The first link is rotated for moving the backrest from a stationary position to a rearward inclined condition. The second link and the third link are respectively rotated to raise the intermediate base block and a seat surface of the reclining block from stationary positions to specified heights.

15 Claims, 12 Drawing Sheets

CHAIR ASSISTING RISING MOVEMENTS

FIELD OF THE INVENTION

The present invention relates to a chair assisting rising movements, and more particularly to a chair assisting rising movements provided with a reclining function and a rising function.

BACKGROUND OF THE INVENTION

Chairs provided with reclining functions are conventionally known in which backseats may be tilted rearward for enabling comfortable postures.

However, it is the case with such conventional chairs provided with reclining functions that persons with weakened leg muscles find it hard to perform sitting actions or rising actions since they need to take stooped postures.

SUMMARY OF THE INVENTION

The present invention has been made in view of the above drawback of the prior art, and it is an object thereof to provide a chair assisting rising movements enabling easy sitting and rising actions and being superior in safety and comfort.

It is another object thereof to provide a chair assisting rising movements that is comfortable at the time of performing rising action, sitting action or in reclined condition, on which one may take safe and comfortable posture, whose armrests are easy-to-use, in which wiring from the control circuit box can be shortened, and with which height adjustment may be easily performed to suit short persons and tall persons.

For solving the above subjects, the present invention provides a chair assisting rising movements that is comprised of a reclining block 1 including a seat surface 2*a* and a backrest 3 that can be tilted in a rearward direction, a mount base block 20 that is placed on a floor surface, and an intermediate base block 15 provided between these blocks, the chair further comprising a first link 4 for connecting the reclining block 1 to a rear end portion 15*b* of the intermediate base block 15 in a freely rotating manner, a second link 5 for connecting a front portion 20*f* of the mount base block 20 to a front end portion 15*a* of the intermediate base block 15 in a freely rotating manner, and a third link 6 for connecting a rear portion 20*g* of the mount base block 20 to the rear end portion 15*b* of the intermediate base block 15 in a freely rotating manner, and the chair further comprising a reclining movement mechanism 7 for moving the backrest 3 from a stationary position to a rearward tilted condition through rotation of the first link 4, and a rising movement mechanism 8 for raising the seat surface 2*a* of the reclining block 1 from a stationary position to a specified height via the intermediate base block 15 through rotation of the second link 5 and the third link 6.

With this arrangement, a comfortable posture can be taken by tilting the backrest 3 of the reclining block 1, and the seat surface may be raised to a suitable height when performing sitting or rising action by moving the intermediate base block 15 upward so that sitting and rising may be easily performed without stooping.

It is further preferable that the second link 5 and the third link 6 are arranged to be of different lengths such that the rear end portion 15*b* of the intermediate base block 15 becomes higher than its front end portion 15*a* at the time of rising movement. With this arrangement, the seat surface 2*a* will be inclined in a front-downward manner when the intermediate base block 15 is pushed upward such that it is inclined in a front-downward manner at the time of rising movement, and a person taking seat may perform sitting and rising actions in a more comfortable manner.

It is further preferable that the chair is of an arrangement in which the load applied to the second link 5 and the third link 6 at the time of rising movement is not reversed during rotation of the links. In other words, by continuously making load apply on the second link 5 (or similarly to the third link 6) in a single direction from above, jerkiness at the time of rising movement can be eliminated.

It is further preferable that the intermediate base block 15 is provided with a receiving member 21 for maintaining the intermediate base block 15 mounted on the mount base block 20 in the stationary position. In this case, by making the receiving member 21 mount on the mount base block 20 when the intermediate base block 15 has returned to its stationary position, occurrence of rattling movement can be prevented at the time of taking a seat or reclining.

It is further preferable that a footrest 12 is connected in a freely rotating manner to a front end side of the seat surface 2*a* of the reclining block 1, and the chair being provided with a control portion 16 for enabling rising movement only when the footrest 12 and the backrest 3 are in stationary positions. With this arrangement, it is possible to prevent the reclining block 1 from erroneously performing upward movement at the time of performing reclining movement of the backrest 3 or when using the footrest 12.

It is further preferable that in case an operation for rising movement is directed when the backrest 3 and the footrest 12 are not in stationary positions, the control portion 16 performs rising movement only after the backrest 3 and the footrest 12 returned to their stationary positions. With this arrangement, it is possible to eliminate trouble such as operating the rising switch many times.

It is further preferable that the chair is provided with a mechanism of varying an angle of the seat surface 2*a* at the time of reclining movement of the backrest 3. With this arrangement, the user can comfortably lay down in a natural posture since the angle of the seat surface 2*a* is varied at the time of reclining movement.

It is further preferable that the chair is arranged in that a central side of the seat surface 2*a* is supported by the intermediate base block 15 in a freely rotating manner while a rear end portion 2*b* of the seat surface 2*a* is suspended from the backrest 3 via a suspending link 9. With this arrangement, the mechanism for varying the angle of the seat surface 2*a* when the backrest 3 is reclined can be realized in a small-sized and light-weighted manner.

It is further preferable that armrests 11 are fixed to the seat surface 2*a* such that their angles with respect to the seat surface 2*a* are maintained to be constant. With this arrangement, the armrests 11 descent together with the declining of the seat surface 2*a* in linkage with the backrest 3 upon reclining the backrest 3 so that a posture for resting one's arms will not become unnatural.

It is further preferable that a control circuit box incorporating the control portion 16 therein is mounted to the intermediate base block 15. With this arrangement, wiring from the control circuit box can be shortened even at the time of reclining movement and rising movement.

It is further preferable that the rising movement mechanism 8 is comprised of an electric actuator for raising movement 8*a* for rotating the second link 5 and the third link 6, the electric actuator for raising movement 8*a* being disposed to be substantially horizontal to the floor surface 22. With this arrangement, an internal mechanism of the chair assisting rising movements can be low and the seat surface 2*a* can be maintained at a low level as well.

It is further preferable that the chair is provided with an adaptor 23 for adjusting a height of the seat surface 2*a* with respect to the floor surface 22. With this arrangement, height adjustment for short and tall persons can be performed by the adaptor 23.

It is further preferable that the chair is provided with a mechanism for decreasing a height of the seat surface 2*a* to be lower than that of the stationary position when performing reclining movements of the backrest 3. With this arrangement, a comfortable posture can be taken at the time of performing reclining movements.

DESCRIPTION OF THE PREFERRED EMBODIMENTS

The present invention will now be explained based on embodiments as illustrated in the accompanying drawings.

Figure 1:
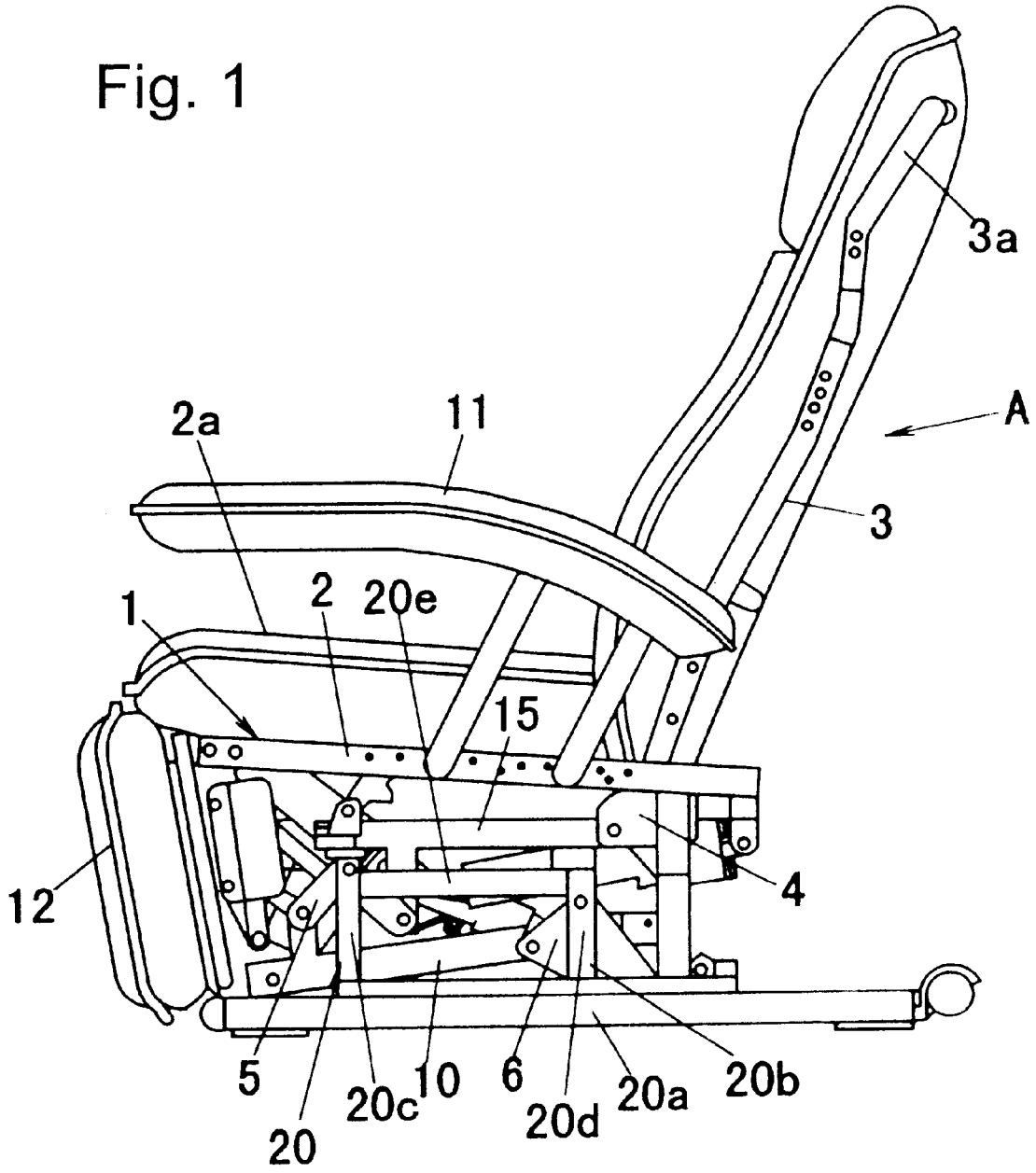
FIG. 1 is a side view showing an embodiment of the present invention.
Figure 2:
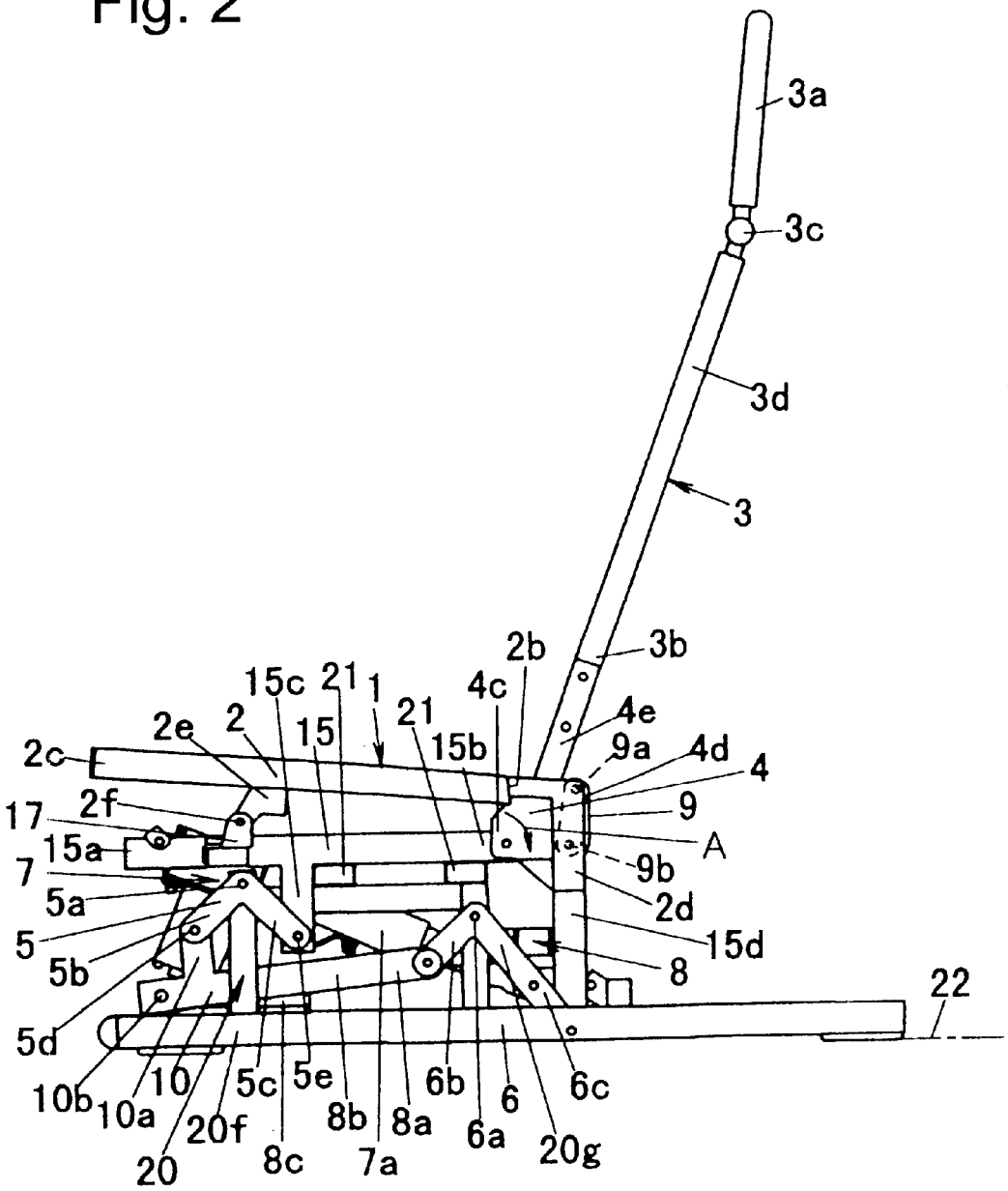
FIG. 2 is an exploded view of the embodiment of FIG. 1.

As illustrated in FIGS. 1 and 2, the chair assisting rising movements A of the present embodiment is separated into a reclining block 1 including a seat surface 2*a* and a backrest 3 that may be tilted in a rearward direction, a mount base block 20 that is placed on a floor surface, and an intermediate base block 15 provided between these blocks. The reclining block 1 and the mount base block 20 are respectively connected to the intermediate base block 15 via links (to be described later), wherein the reclining block 1, the intermediate base block 15, and the mount base block 20 are arranged to be movable in a mutually independent manner. In the present embodiment, armrests 11 are fixed to a seat surface block 2. With this arrangement, the armrests 11 are fixed such that their angles with respect to a seat surface 2*a* whose height and angle are varied at the time of reclining movement are maintained constant.

An upper portion 3*a* of the backrest 3 is separately provided from a main body portion 3*d* with a pivotally supporting portion 3*c* being interposed between, wherein the angle of the upper portion 3*a* is arranged to be variable with respect to the main body portion 3*d* so that the height of one's head may be easily adjusted when the chair is in a reclined condition. At a front end portion 2*c* of the seat surface 2*a* of the reclining block 1, a footrest 12 is further provided in a manner that it can freely taken in and out by means of an electric actuator for footrest 30 (to be described later) (FIGS. 8 to 11).

The reclining block 1 is separated into the seat surface block 2 including the seat surface 2*a* and the backrest 3.

Figure 6:
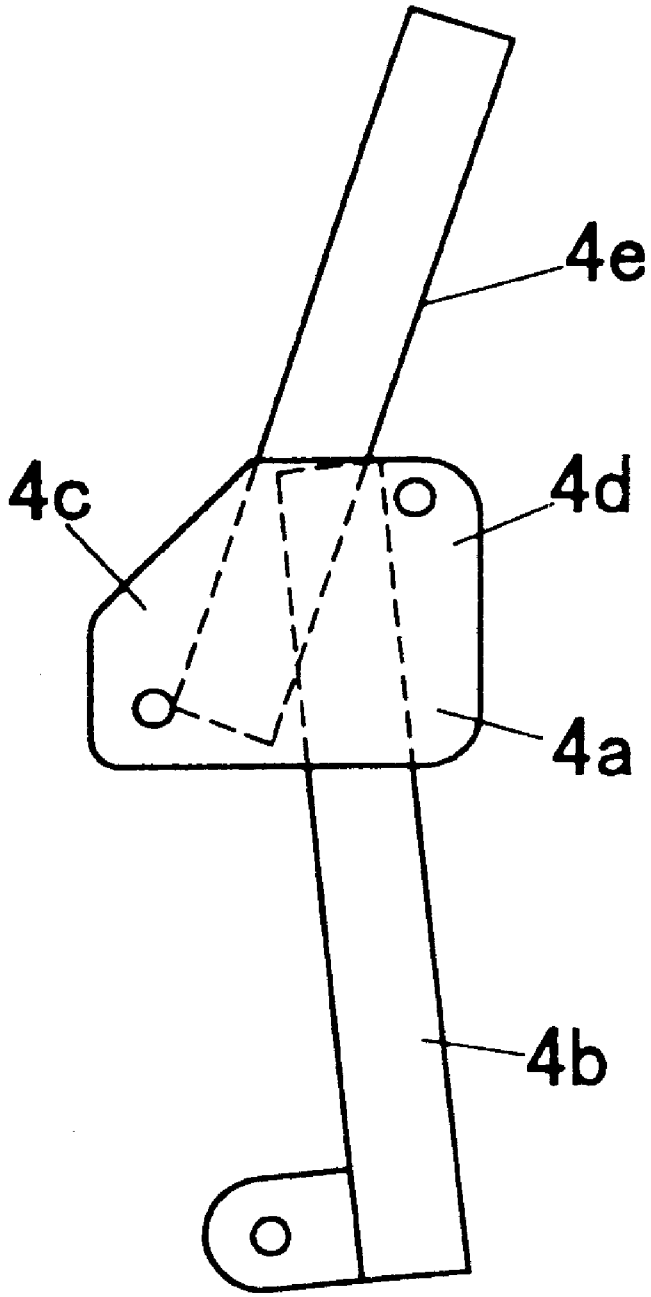
FIG. 6 is a front view of a first link of the embodiment of the present invention.

A first link 4 as illustrated in FIG. 6 is fixedly attached to a lower end portion 3*b* of the backrest 3. Within the first link 4, a connecting piece 4*a* through which a front end portion 4*c* is connected to a rear end portion 15*b* of the intermediate base block 15 in a freely rotating manner, a backrest fixing portion 4*e* projecting in an oblique upward direction from an upper end of the connecting piece 4*a*, and a projecting piece 4*b* projecting downward from a lower end of the connecting piece 4*a* are integrally formed.

As illustrated in FIG. 2, a movable metal fitting 2*e* is provided to project from a lower surface on a central side of the seat surface block 2, and a fixing member 17 for supporting the movable metal fitting 2*e* in a freely rotating manner is provided to project from the intermediate base block 15, wherein the angle of the seat surface block 2 is freely variable with a pivotally attached portion 2*f* between the fixing member 17 and a connecting member being the center of rotation. A hanging piece 2*d* hanging downward is integrally provided to the rear end potion 2*b* of the seat surface block 2, to this hanging piece 2*d*, one end 9*b* of the suspending link 9 is connected in a freely rotating manner while the other end 9*a* of the suspending link 9 is connected to a rear end portion 4*d* of the connecting piece 4*a* of the first link 4 in a freely rotating manner.

The intermediate base block 15 is provided with a reclining movement mechanism 7 for rotating the first link 4 and moving the backrest 3 from the stationary position to a rearward tilted condition. The reclining movement mechanism 7 of the present embodiment is comprised of an electric actuator for reclining movement 7*a*, with a rod portion 7*c* being connected to the lower end portion 3*b* of the first link 4 in a freely rotating manner and a main body portion thereof being connected to the front end portion 15*a* of the intermediate base block 15 in a freely rotating manner.

By extending the rod portion 7*c*, the first link 4 is rotated in a counterclockwise direction for moving the backrest 3 in a forward raising direction, and on the other hand, by shrinking the rod portion 7*c*, the first link 4 is rotated in a counterclockwise direction Y for moving the backrest 3 in a rearward tilting direction. The chair further employs a mechanism in which the suspending link 9 descend and the height of the seat surface 2*a* is lowered from the stationary position when the first link 4 is rotated in a clockwise direction when performing reclining movement of the backrest 3. At the same time, the chair employs a mechanism for varying the angle of the seat surface 2*a* by descending the rear end portion 2*b* alone of the seat surface 2*a* because the central side of the seat surface 2*a* is supported by the intermediate base block 15 in a freely rotating manner.

The mount base block 20 is comprised of a mount portion 20*a* and a fixed frame portion 20*b* provided to erect upward from the mount portion 20*a*. An electric actuator for raising movement 8*a* is mounted to the mount portion 20*a* in a horizontal posture. A rod portion 8*c* of the electric actuator for raising movement 8*a* is connected to a link connecting bar 10 which mutually connects the second link 5 and the third link 6, thereby comprising a rising movement mechanism 8 for moving the intermediate base block 15 upward.

The fixed frame portion 20*b* of the mount base block 20 is comprised of a front frame 20*c*, a rear frame 20*d* and an upper lateral frame 20*e*, wherein a substantially L-shaped central portion of the second link 5 is connected to an upper end portion of the front frame 20*c* in a freely rotating manner while a substantially L-shaped central portion 6*a* of the third link 6 is connected to an upper end portion of the rear frame 20*d* in a freely rotating manner.

A short link 5*b* of the second link 5 is connected in a freely rotating manner to a protruding portion 10*a* on a front side of the link connecting bar 10 which is connected to the electric actuator for raising movement 8*a*, and a short link 5*c* is connected in a freely rotating manner to a front side hanging piece 15*c* which hangs from a front side of the intermediate base block 15. A short link 6*b* of the third link 6 is connected to a rear end side of the link connecting bar 10 in a freely rotating manner, while its long link 6*c* is connected in a freely rotating manner to a lower end side of a rear side hanging piece 15*d* which hangs from a rear side of the intermediate base block 15.

The rod portion 8*c* of the electric actuator for raising movement 8*a* is axially supported by a front end portion 10 of the link connecting bar 10 so that by shrinking the rod portion 8*c*, the link connecting bar 10 is moved rearward and both the second link 5 and the third link 6 are rotated in a counterclockwise direction for raising the intermediate base block 15. On the other hand, by extending the rod portion 8*c*, the link connecting bar 10 is moved frontward and both the second link 5 and the third link 6 are rotated in a clockwise direction for descending the intermediate base block 15.

Figure 4:
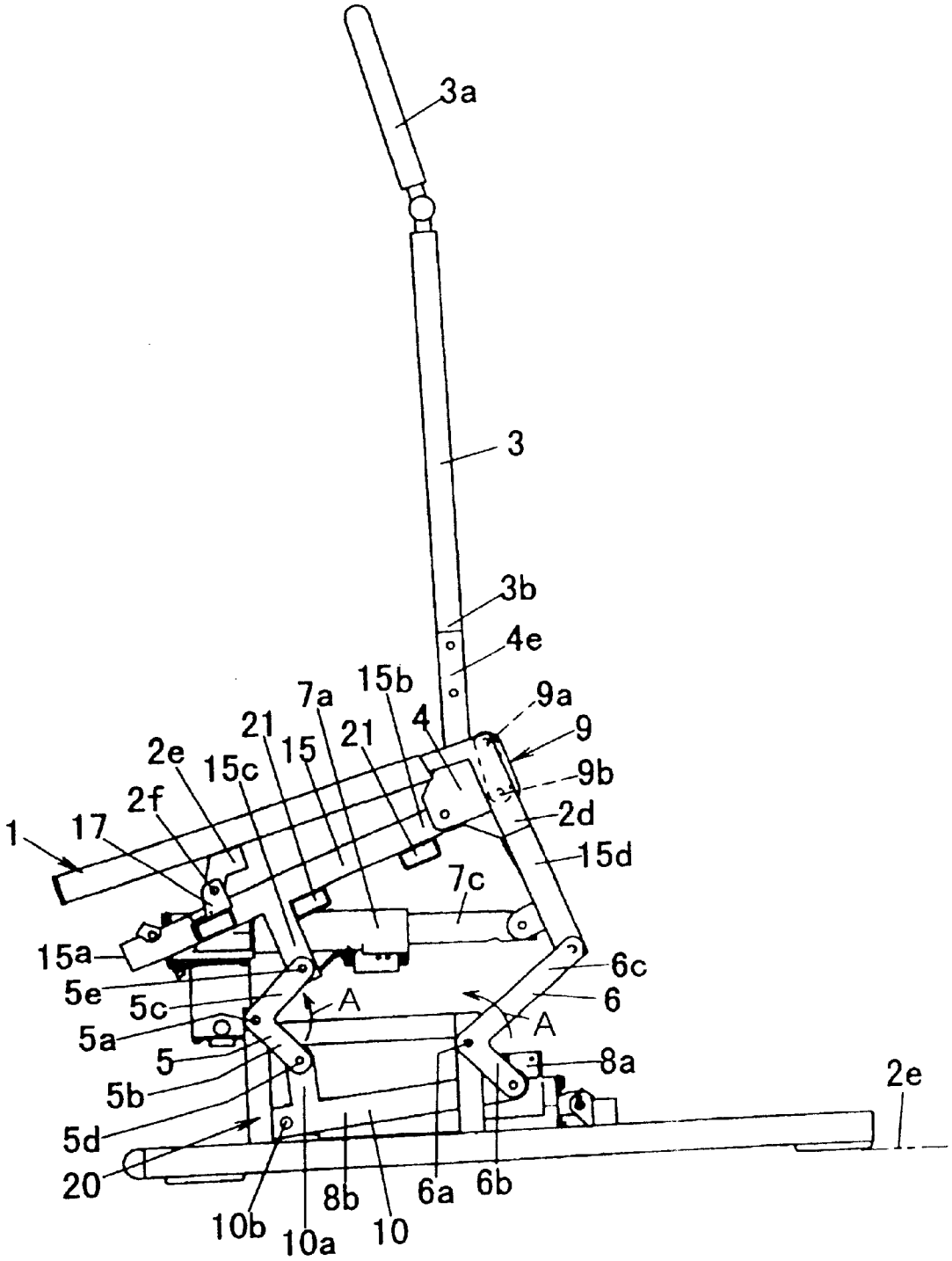
FIG. 4 is a side view for explaining conditions in which an intermediate base block and a reclining block are moved upward.

In the present embodiment, the long link 6*c* of the third link 6 is arranged to be of longer dimension than the short link 5*c* of the second link 5, thereby providing an arrangement in which the rear end portion 15*b* of the intermediate base block 15 becomes higher than its front end portion 15*a* when performing rising movement of the intermediate base block 15. The chair is further arranged in that the load applied on the second link 5 and the third link 6 is not reversed at some midpoint within a range in which the intermediate base block 15 moves from a lower limit position as illustrated in FIG. 1 to an upper limit position as illustrated in FIG. 4.

More particularly, within the range of rotation of the second link 5 (and similarly of the third link 6), a line that connects a connecting point 5*ad* of the second link 5 and a connecting point 5*e* does not become vertical with respect to the floor surface 22 and the load applied from above is continuously applied on the second link 5 in a single direction (in the illustrated example, in a clockwise direction). Thus, it is possible to prevent cases in which the load applied from above is either applied to the second link 5 in a single direction (clockwise direction) at one time and from another direction (counterclockwise direction) at another time so as to consequently eliminate jerkiness at the time of performing rising movement.

Figure 5:
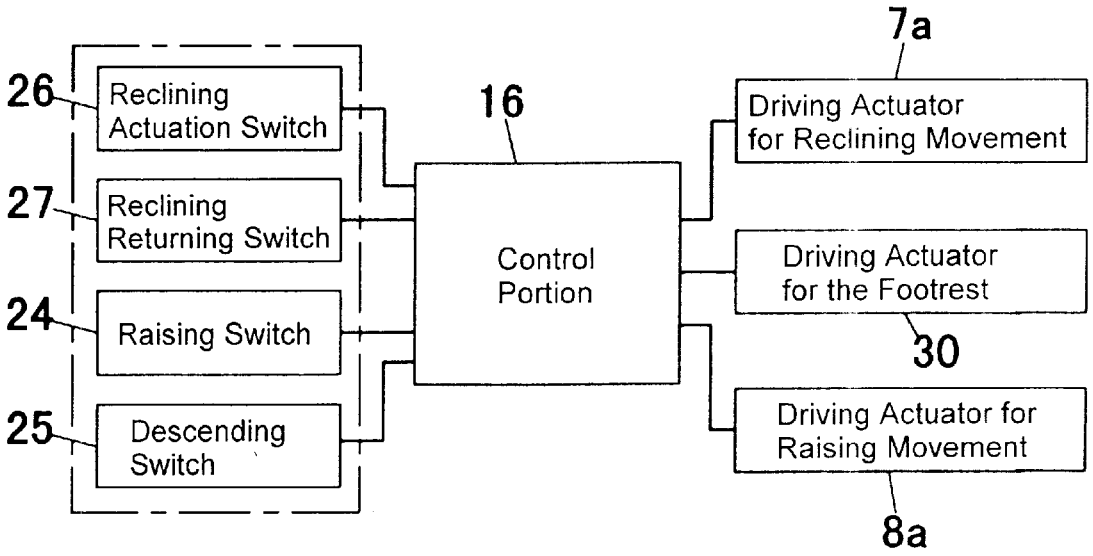
FIG. 5 is a block diagram of the control circuit box for the embodiment of the present invention.

A control circuit box (not shown) is mounted to the intermediate base block 15, wherein a control portion 16 realized by a microcomputer or similar is accommodated in an interior of the box. The control portion 16 is for making the electric actuator for reclining movement 7*a* perform extending movement by actuating a "reclining movement switch 26" and for making the electric actuator for reclining movement 7*a* perform shrinking movement by actuating a "reclining returning switch 27" that are respectively provided in a switch operator as illustrated in FIG. 5. By actuating a "raising switch (button for rising movement) 24", the electric actuator for raising movement 8*a* is made to perform shrinking movement, and by actuating a "descending switch 25", the electric actuator for raising movement 8*a* is made to perform extending movement.

In the present embodiment, when the "raising switch 24" is actuated when the backrest 3 and the footrest 12 are not at their stationary positions, the control portion 16 is arranged such that it does not immediately drive the electric actuator for raising movement 8*a* but await until the backrest 3 and the footrest 12 have returned their stationary positions and perform rising movement after return. Here, a stationary position for the footrest 12 is a position in which it is folded and accommodated downward of the seat surface 2*a*. A stationary position for the backrest 3 is an ordinary position for use in which it is not tilted rearward, and a position of the seat surface 2*a* at this time is defined to be a stationary position of the seat surface 2*a*.

A receiving member 21 that is supported on the upper lateral frame 20*e* of the mount base block 20 is provided on a lower surface of the intermediate base block 15, thereby holding the intermediate base block 15 at the lower limit position.

Figure 3:
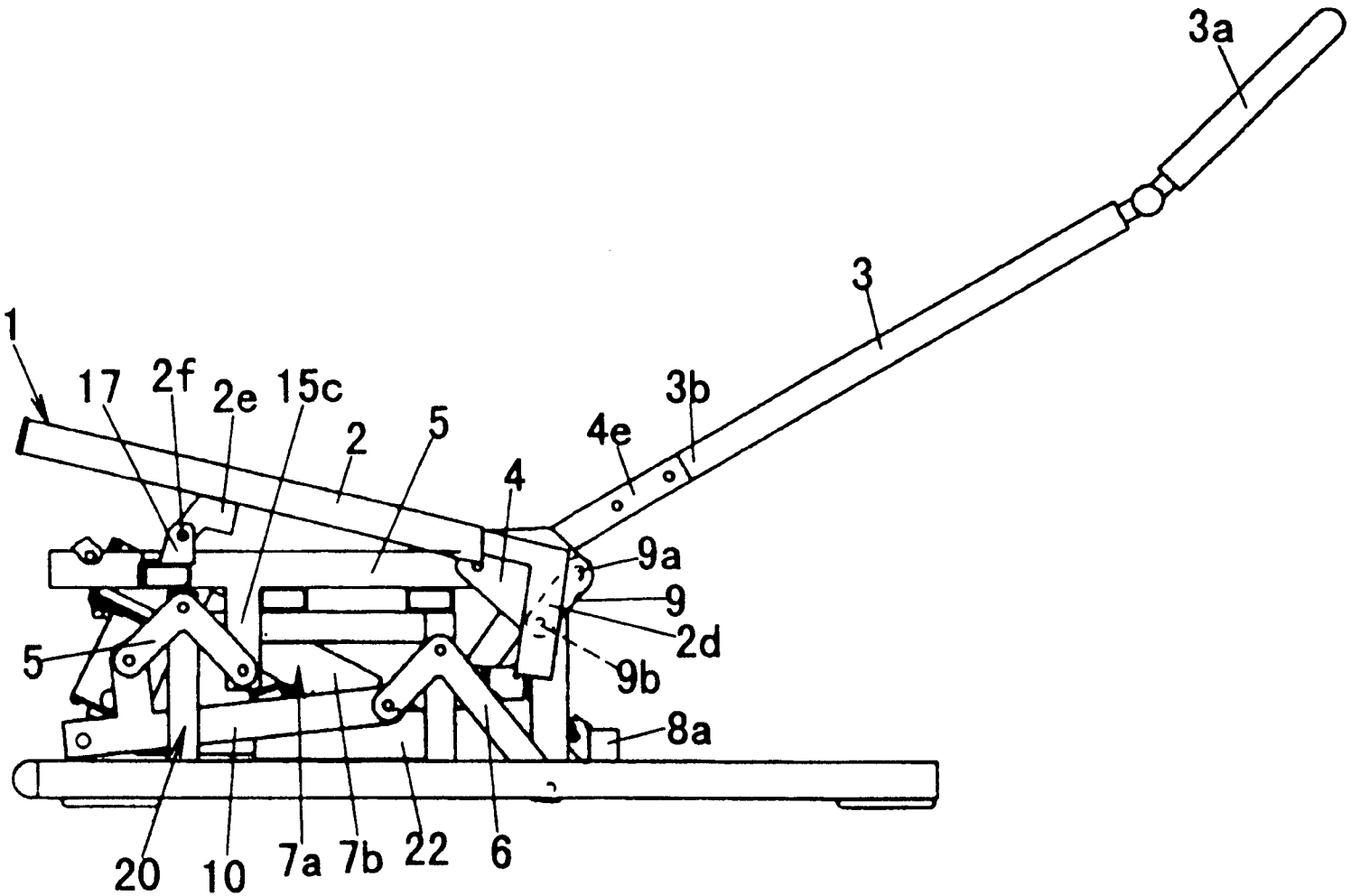
FIG. 3 is a side view for explaining a reclined condition of a backrest of the embodiment of FIG. 2.

One example of movement will now be explained. When the reclining movement switch 26 is actuated, the electric actuator for reclining movement 7*a* is expanded for rotating the first link 4 in a clockwise direction Y such that the backrest 3 performs reclining movement as illustrated in FIG. 3. At this time, the seat surface block 2 that is suspended at the backrest 3 via the suspending link 9 descends in linkage with the reclining movement with a pivotally attached portion 2*f* between the seat surface block 2 and the intermediate base block 15 being the fulcrum so that the user can take a comfortable posture. It should be noted that by actuating the reclining returning switch 27, the electric actuator for reclining movement 7*a* is shrunk so that the first link 4 is rotated in a counterclockwise direction, thereby returning the backrest 3 to the stationary position as illustrated in FIG. 1.

Figure 7:
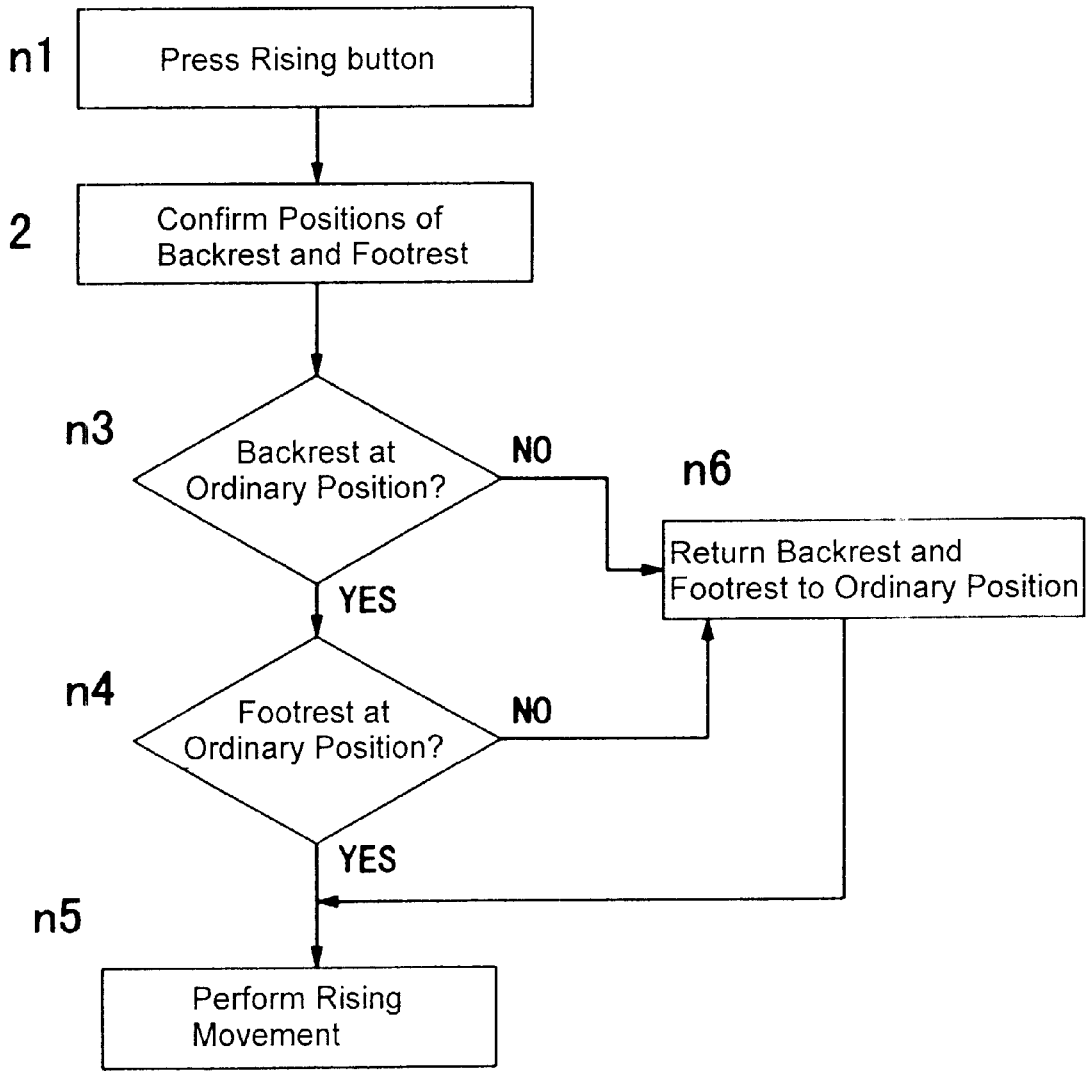
FIG. 7 is a flow chart for explaining an operation of the embodiment of the present invention.

Next, when the raising switch (rising movement button) 24 is actuated, the flow of movement of FIG. 7 will be performed. More particularly, the process proceeds from Step n1 to Step n2, and the control portion 16 confirms the positions of the backrest 3 and the footrest 12. At this time, when it is detected that both of the backrest 3 and the footrest 12 are not at ordinary positions, the process moves to Step n6 for returning the backrest 3 and the footrest 12 to the ordinary positions. When both of the backrest 3 and the footrest 12 are at ordinary positions, the process proceeds with Step n5 for performing rising movement. More particularly, the electric actuator for raising movement 8*a* is shrunk for moving the link connecting bar 10 rearward. With this arrangement, both of the second link 5 and the third link 6 are rotated in a counterclockwise direction X for pushing the intermediate base block 15 upward so that the reclining block 1 is moved upward to a specified height as illustrated in FIG. 4. Since the second link 5 in the front is arranged to be longer than the third link 6 in the back at this time, the intermediate base block 15 will be in a front-downwardly inclined condition so that the seat surface 2*a* of the reclining block 1 will be consequently pushed up in a similarly front-downwardly inclined condition, thereby enabling easy seating and rising.

When the descending switch 25 is actuated, the electric actuator for raising movement 8*a* will be expanded to move the link connecting bar 10 frontward such that both the second link 5 and the third link 6 are accordingly rotated in a clockwise direction to make the intermediate base block 15 descend. By the descending movement of the reclining block 1 at this time, the intermediate base block 15 returns from the front-downwardly inclined condition to the horizontal condition, and by the receiving member 21 of the intermediate base block 15 abutting against the mount base block 20, the reclining block 1 is returned to the stationary position as illustrated in FIG. 1.

By raising the reclining block 1 to an appropriate height and thus to raise the portion of the seat surface 2*a* when seating on or rising from the seat surface 2*a* in this manner, it is possible to comfortably perform seating or rising actions without stooping. Moreover, since the third link 6 located on a rear side is arranged to be longer than the second link 5 located on a front side, the intermediate base block 15 will be pushed up to be front-downwardly inclined when performing rising movement and thus to incline the seat surface 2*a* of the reclining block 1 in a front-downward manner so that a person taking seat may comfortably perform seating and rising actions. It is particularly easy for persons with weakened leg muscles to perform rising actions when the backrest 3 and the seat surface 2*a* are moved obliquely upward in this condition. Further, by the use of the electric actuator, the reclining movement mechanism 7 and the rising movement mechanism 8 can be easily driven through electric driving.

When the backrest 3 is being reclined in performing reclining movement, the user may comfortably lay down in a natural posture by varying the angle of the seat surface 2*a*. Moreover, by supporting the rear end portion 2*b* of the seat surface 2*a* at the backrest 3 in a suspending manner via the suspending link 9, the mechanism for varying the angle of the seat surface 2*a* when the backrest 3 is being reclined may be realized in a small-sized and light-weighted manner. In other words, since the backrest 3 descends when it is being reclined, the rear end portion 2*b* of the seat surface 2*a* that is suspended at the backrest 3 via the suspending link 9 simultaneously descends, and since the central side of the seat surface 2*a* is pivotally supported at the intermediate base block 15, the angle of the seat surface 2*a* is rear-downwardly inclined, thereby providing successiveness between the backrest 3 and the seat surface 2*a*. As a result, users can lay down in a more comfortable posture.

Further, since the armrests 11 are fixed to the seat surface 2*a* such that angles thereof with respect to the seat surface 2*a* are maintained constant, a posture for resting the arms on the armrests 11 becomes comfortable. It should be noted that it was often the case in the prior art that armrests 11 are fixed to a main body frame so that angles of the armrests 11 with respect to the seat surface 2*a* became unnatural at the time of reclining so that a posture for resting the arms on the armrests 11 was not at all comfortable. In contrast thereto, as the seat surface 2*a* descends in linkage with the backrest 3 when reclining in the present embodiment and the armrests 11 descends together therewith, the posture for resting the arms does not become unnatural and a comfortable posture can be taken. Moreover, since the angle of the upper portion 3*a* of the backrest 3 is variable, the height of one's head can be easily adjusted when in a reclined condition so that it is possible to take a comfortable posture such as easily watching TV.

By the rotation of the first link 4 in a clockwise direction when performing reclining movement of the backrest 3, the suspending link 9 descends and the rear end portion 2*b* of the seat surface 2*a* descends as well so that the height of the seat surface 2*a* can be lowered from the stationary position, and by varying the angle of the seat surface 2*a* to an angle in which it is successive to the backrest 3, it is possible to take a comfortable posture.

Moreover, since the above-explained arrangement is employed in which the load applied on the second link 5 and the third link 6 are not reversed at some midpoint during rising movement, it is possible to eliminate jerkiness at the time of rising movement and the reliability of the rising movement mechanism 8 can be improved.

The provision of the receiving member 21 at the intermediate base block 15 for holding the intermediate base block 15 at the stationary position by being mounted on the mount base block 20, the receiving member 21 is mounted on the mount base block 15 when the intermediate base block 15 returns the stationary position, and it is accordingly possible to prevent occurrence of rattling movement of the intermediate base clock 15 at the time of seating or reclining and to achieve stability of the reclining block 1.

Since rising movement is enabled by the control portion 16 only when the footrest 12 and the backrest 3 are at stationary positions, there is no fear that rising movement is performed when the footrest 12 and the backrest 3 are not in stationary positions or either one of these is not in its stationary position. Since the control portion 16 is arranged such that it will await until the backrest 3 and the footrest 12 return their stationary positions when the footrest 12 and the backrest 3 are not in stationary positions and perform rising movement after return, there is no fear that the reclining block 1 moves upward during reclining movement of the backrest 3 or while using the footrest 12 owing to an erroneous operation or an operation by children just out of fun. It is accordingly possible to secure safety of use particularly for elderly persons or handicapped persons, and it is also possible to eliminate a troublesome such as operating the raising switch many times.

Since the control circuit box incorporating therein the control portion 16 is mounted to the intermediate base block 15, there is an advantage of shortening wiring thereof. In other words, in case of mounting the electric actuator for reclining movement 7*a* composing the reclining movement mechanism 7 to the reclining block 1 and mounting the electric actuator for raising movement 8*a* composing the rising movement mechanism 8 to the mount base block 20, the provision of the control circuit box at the intermediate base block 15 enables it to maintain a distance between the electric actuator for reclining movement 7*a* and the control circuit box short even when performing reclining movements, and it is accordingly possible to shorten wiring from the control circuit box to the electric actuator for reclining movement 7*a*.

Moreover, since the electric actuator for raising movement 8*a* composing the rising movement mechanism 8 is disposed to be substantially horizontal to the floor surface 22, the interior mechanism of the chair assisting rising movement A can be lowered and the seat surface 2*a* can be consequently maintained at a low level as well, thereby enabling comfortable use of the chair also by short persons.

Figure 12:
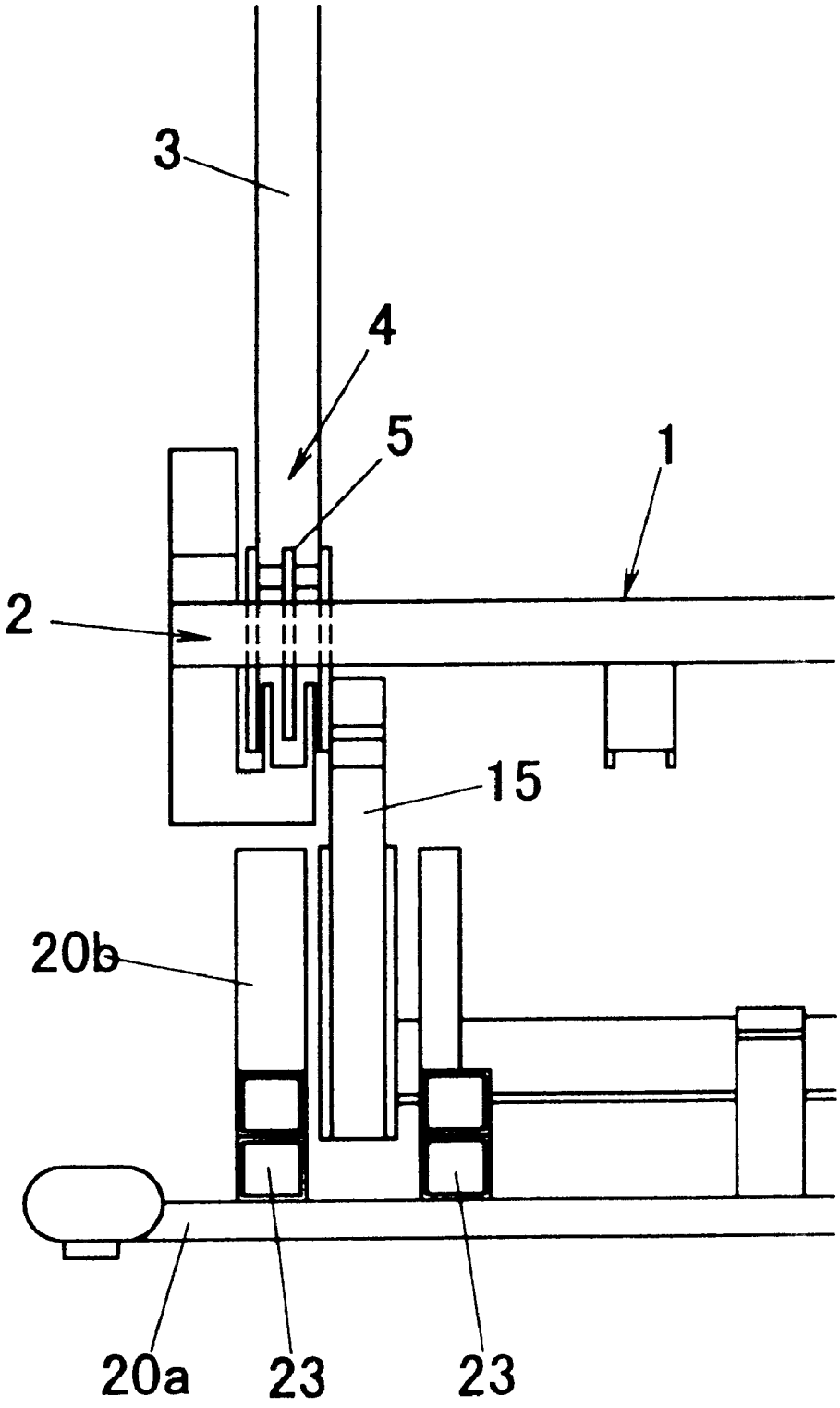
FIG. 12 is a rear view for explaining a condition in which an adaptor for height adjustment is mounted in the embodiment of the present invention.

It is further preferable that the chair is provided with an adaptor 23 for adjusting a height of the seat surface 2*a* with respect to the floor surface 22. As illustrated in FIG. 12, by incorporating the adaptor 23 having a specified height between the mount portion 20*a* and the fixed frame portion 20*b* of the mount base block 20, the seat surface 2*a* can be arranged to be high so that tall persons easily take seat. Further, by detaching the adaptor 23 and directly connecting the mount portion 20*a* and the fixed frame portion 20*b* of the mount base block 20, the seat surface 2*a* can be lowered so that short persons easily take seat. While it is possible to suit tall or short persons by changing sizes of the chair assisting rising movement A (e.g. each size of the reclining block 1, the intermediate base block 15, and the mount base block 20), the present embodiment can correspond to tall or short persons by the presence or absence of the adaptor 23 at the mount base block 20.

FIGS. 8 to 11 illustrate a driving mechanism for the footrest 12 provided at the front end portion 2*c* of the seat surface 2*a* of the reclining block 1. While the footrest 12 is taken in and out by means of the electric actuator 30, it may either be driven electrically or through any other power. In the present embodiment, one end 30*a* of the electric actuator for footrest 30 is connected to the rear end portion 15*b* of the intermediate base block 15 in a freely rotating manner, and a rod portion 31 of the electric actuator for footrest 30 is connected to a rear end portion of a driving plate 45 in a freely rotating manner, as illustrated in FIG.

Figure 9:
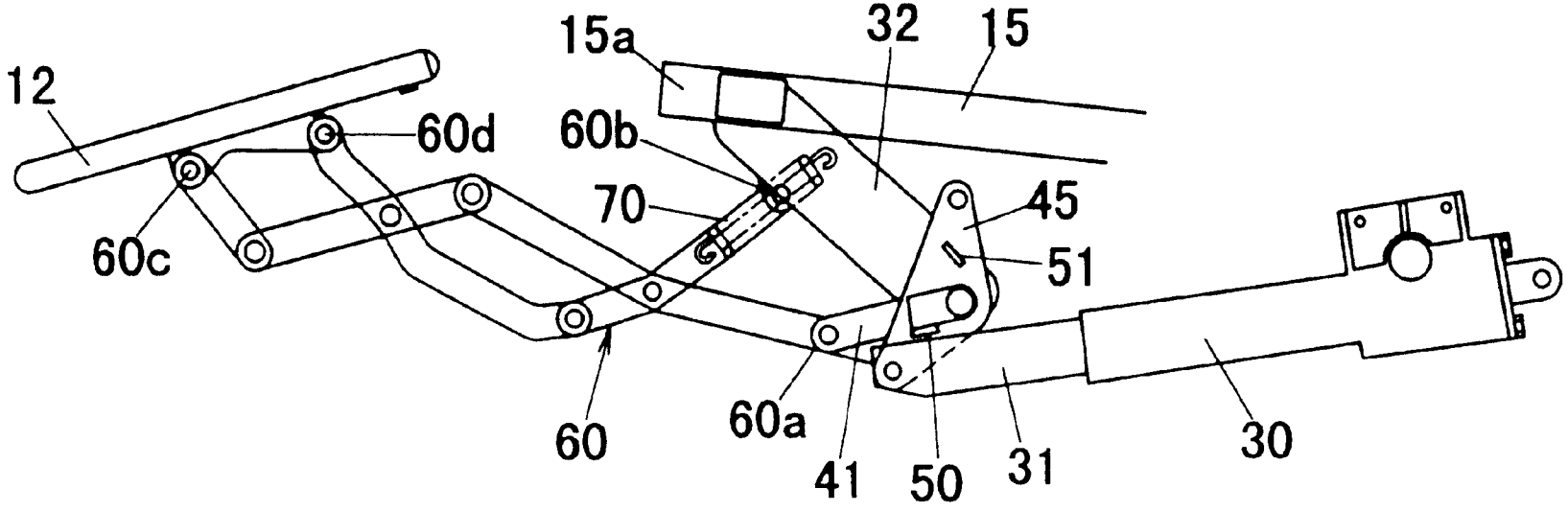
FIG. 9 is a side view in which the above footrest is made to project up to a position of a top dead center.
Figure 10:
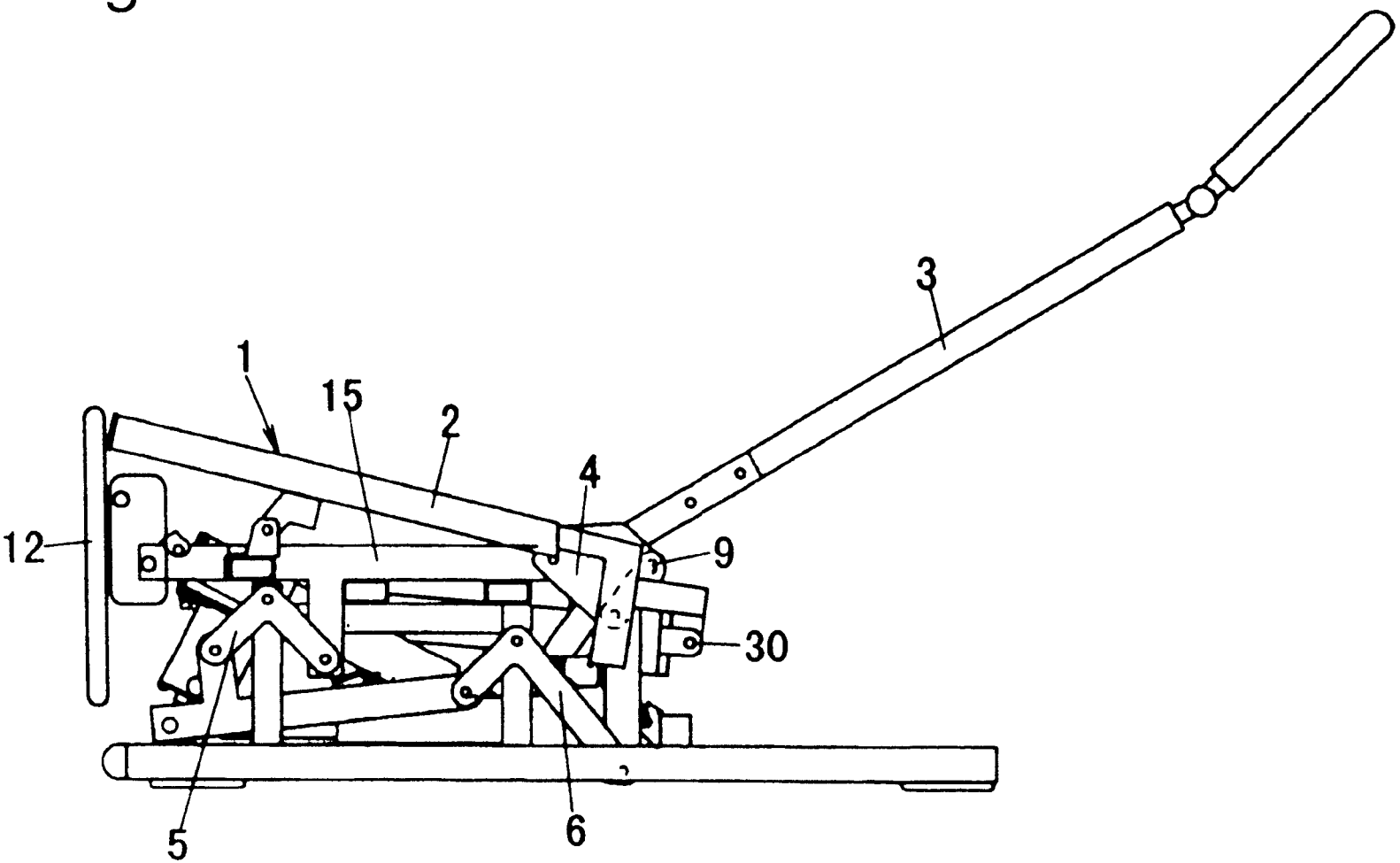
FIG. 10 is a side view for explaining a position of the footrest at the time of reclining movement.
Figure 11:
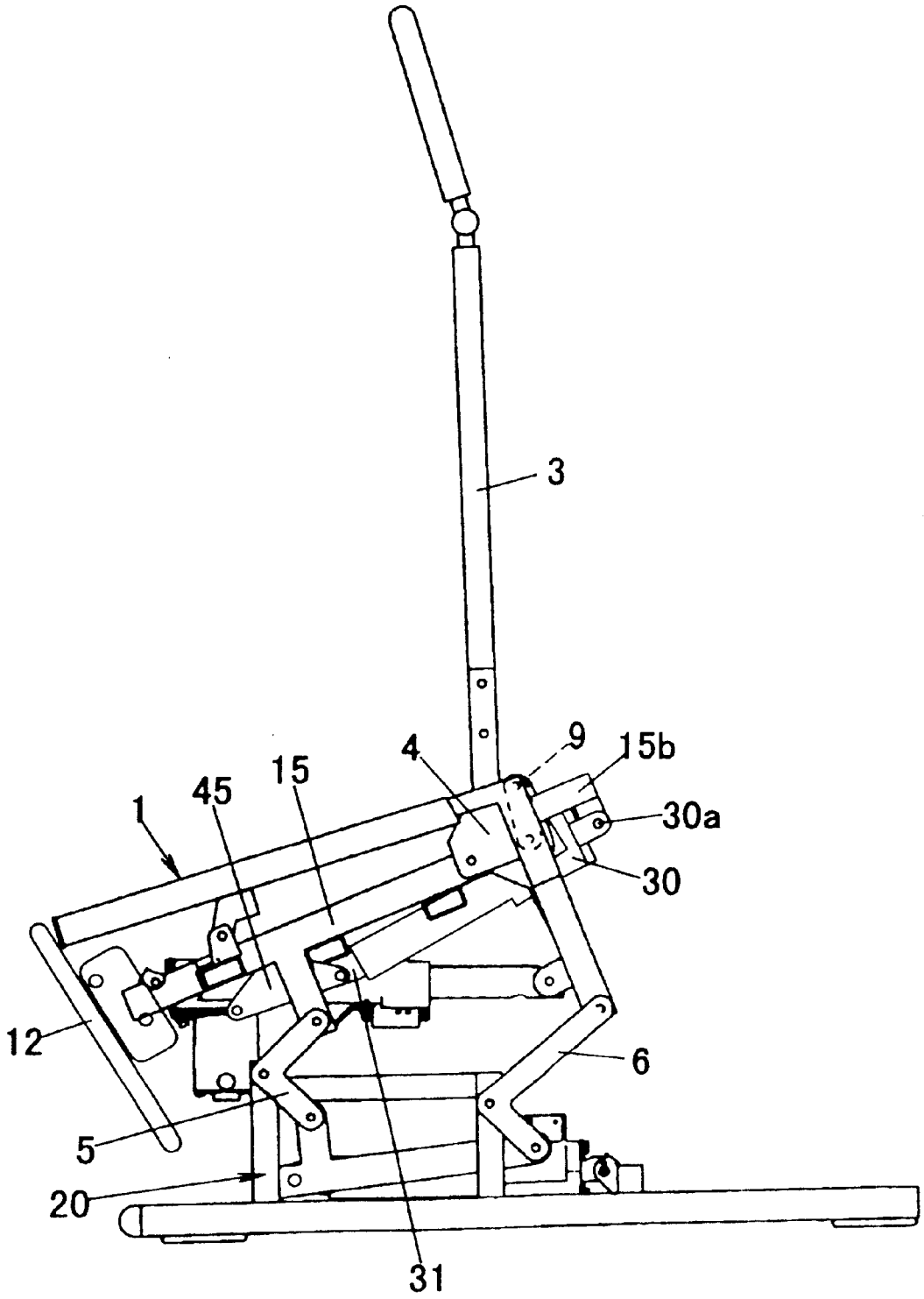
FIG. 11 is a side view for explaining a position of the footrest at the time of rising movement.

As illustrated in FIG. 9, the driving plate 45 is mounted to a lower end portion of a lever mounting shaft 32 that is provided to be hanging from the front end portion 15*a* of the intermediate base block 15 in a freely rotating manner together with a lever 41. On a surface of the driving plate 45, a protrusion for pressurizing 50 and a protrusion for returning 51 are provided in a projecting manner from a rear and front sides, respectively, in this order with the lever 41 located therebetween. Respective ends 60*a*, 60*b* of a pantograph type link mechanism 60 are respectively pivotally attached to a lower end portion of the lever 41 and a central portion of the lever mounting shaft 32, while respective other ends 60*c*, 60*d* of the pantograph type link mechanism 60 are respectively pivotally attached at two, upper and lower portions of the footrest 12. In the drawings, 70 denotes a returning spring for urging the pantograph type link mechanism 60 in a folding direction thereof.

Figure 8:
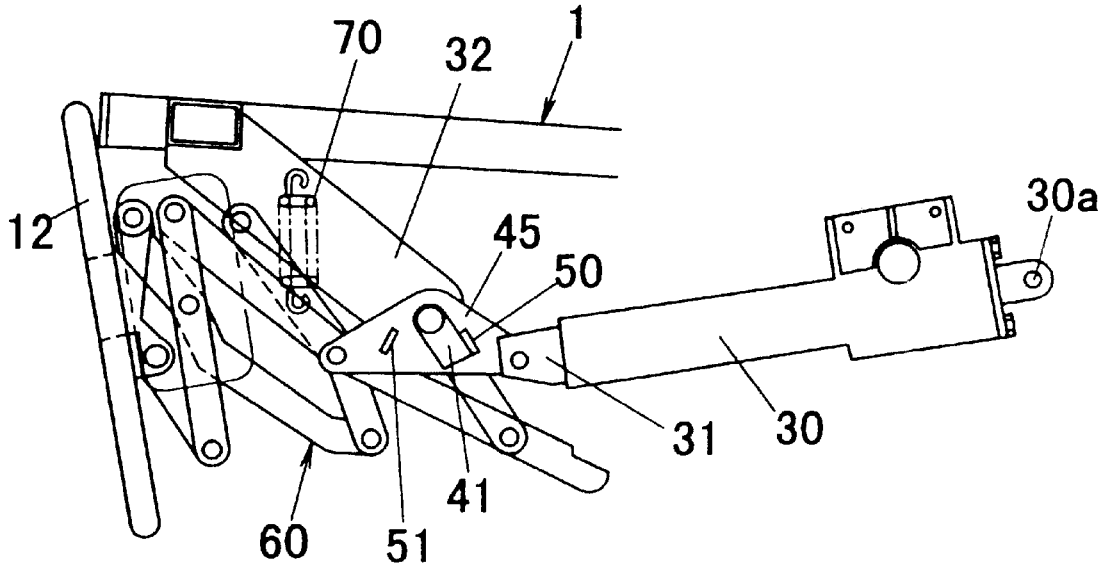
FIG. 8 is a side view showing a driving mechanism of a footrest of the embodiment of the present invention.

By expanding the rod portion 31 of the electric actuator 30, the protrusion for pressurizing 50 pushes the lever 41 for expanding the pantograph type link mechanism 60 so that the footrest 12 is lifted. By shrinking the rod portion 31, the pantograph type link mechanism 60 is folded as illustrated in FIG. 8 and the protrusion for returning 51 returns the lever 41 such that the footrest 12 can be returned to the original accommodated position by an electric actuator 47.

When no protrusion for returning 51 is provided, the pantograph type link mechanism 60 cannot be returned in the folding direction by the returning spring 70 when the footrest 12 has been lifted up to a top dead center (condition of FIG. 9). In other words, at the top dead center of the footrest 12, the returning spring 70 will not work since a link 60*e* of the pantograph type link mechanism 60 and the returning spring 70 are aligned on a straight line, and no matter how much the rod portion 31 of the electric actuator 30 is returned, the footrest 12 is remained holding at the top dead center, and it is accordingly necessary to return it through manual operation by using an operating lever. By the provision of the protrusion for returning 51 as in the present embodiment, the footrest 12 can be returned by using the electric actuator 47 to eliminate the necessity of performing manual operation and to improve operatability thereof.

As explained so far, the invention relates to a chair assisting rising movement comprised of a reclining block including a seat surface and a backrest that can be tilted in a rearward direction, a mount base block that is placed on a floor surface, and an intermediate block provided between these blocks, the chair further comprising a first link for connecting the reclining block to a rear end portion of the intermediate base block in a freely rotating manner, a second link for connecting a front portion of the mount base block to a front end portion of the intermediate base block in a freely rotating manner, and a third link for connecting a rear portion of the mount base block to the rear end portion of the intermediate base block in a freely rotating manner, and the chair further comprising a reclining movement mechanism for moving the backrest from a stationary position to a rearward tilted condition through rotation of the first link, and a rising movement mechanism for raising the seat surface of the reclining block from a stationary position to a specified height via the intermediate base block through rotation of the second link and the third link. With this arrangement, a comfortable posture can be taken by tilting the backrest of the reclining block, and the seat surface may be raised to a suitable height when performing sitting or rising action by moving the intermediate base block upward so that sitting and rising can be easily performed without stooping.

In the invention, the second link and the third link are arranged to be of different lengths such that the rear end portion of the intermediate base block becomes higher than its front end portion at the time of rising movement. With this arrangement, the seat surface will be inclined in a front-downward manner when the intermediate base block is pushed upward such that it is inclined in a front-downward manner at the time of rising movement, and a person taking seat can perform sitting and rising actions in a more comfortable manner. It is particularly easy for persons with weaken leg muscles to perform rising movement when the backrest and the seat surface are moved obliquely upward in this condition.

In the invention, the chair is of an arrangement in which the load applied to the second link and the third link at the time of rising movement is not reversed during rotation. With this arrangement, the load applied from above is continuously made to be applied on the second link 5 (or similarly to the third link 6) in a single direction so that jerkiness at the time of rising movement can be eliminated and reliability of the rising movement mechanism improved.

In the invention, the intermediate base block is provided with a receiving member mounted on the mount base block for maintaining the intermediate base block in the stationary position. With this arrangement, by making the receiving member mount on the mount base block when the intermediate base returns to its stationary position, occurrence of rattling movement of the intermediate base block can be prevented at the time of taking a seat or reclining, and stability of the reclining block can be achieved.

In the invention, a footrest is connected in a freely rotating manner to a front end side of the seat surface of the reclining block, and the chair being provided with a control portion for enabling rising movements only when the footrest and the backrest are in stationary positions. With this arrangement, there is no fear that the reclining block moves erroneously upward during reclining movements of the backrest or while using the footrest, and it is accordingly possible to secure safety of use particularly for elderly persons or handicapped persons.

In the invention, in case an operation for rising movement is directed when the backrest and the footrest are not in stationary positions, the control portion performs rising movement only after the backrest and the footrest have returned their stationary positions. With this arrangement, it is possible to eliminate a troublesome such as pushing the rising switch many times.

In the invention, the chair is provided with a mechanism of varying the angle of the seat surface at the time of reclining movement of the backrest. With this arrangement, the user can comfortably lay down in a natural posture since the angle of the seat surface varies when the backrest is in the reclined condition.

In the invention, the chair is arranged in that a central side of the seat surface is supported by the intermediate base block in a freely rotating manner while a rear end portion of the seat surface is suspended from the backrest via a suspending link. With this arrangement, the mechanism for varying the angle of the seat surface when the backrest is reclined can be realized in a small-sized and light-weighted manner.

In the invention, armrests are fixed to the seat surface such that their angles with respect to the seat surface are maintained to be constant. With this arrangement, the armrests descend together with the declining of the seat surface in linkage with the backrest upon reclining the backrest so that a posture for resting one's arms does not become unnatural.

In the invention, a control circuit box incorporating therein the control portion is mounted to the intermediate base block. With this arrangement, a wiring from the control circuit box can be shortened though still enabling reclining movements and rising movement.

In the invention, the rising movement mechanism is comprised of an electric actuator for raising movement for rotating the second link and the third link, the electric actuator for raising movement being disposed to be substantially horizontal to the floor surface. With this arrangement, an internal mechanism of the chair assisting rising movement can be lowered and the seat surface can be maintained at a low level as well so that the chair can be comfortably used also by short persons.

In the invention, as the chair is provided with an adaptor for adjusting a height of the seat surface with respect to the floor surface, an adjustment of the height of the chair to both short and tall person is possible by the adapter. Thus, a single chair assisting rising movement can suit short persons and tall persons.

In the invention, the chair is provided with a mechanism for reducing a height of the seat surface to be lower than that of the stationary position when performing reclining movement of the backrest. With this arrangement, one can take a comfortable posture at the time of reclining movements.

Although only a preferred embodiment is specifically illustrated and described herein, it will be appreciated that many modifications and variations of the present invention are possible in light of the above teachings and within the purview of the appended claims without departing the spirit and intended scope of the invention.

What is claimed is:

1. A chair for assisting rising movement formed of a reclining block with a seat surface and a backrest that can be tilted in a rearward direction, a mount base block that is placed on a floor surface, and an intermediate base block provided between these blocks, comprising:

a first link for connecting the reclining block to a rear end portion of the intermediate base block in a freely rotating manner;

a second link for connecting a front portion of the mount base block to a front end portion of the intermediate base block in a freely rotating manner;

a third link for connecting a rear portion of the mount base block to the rear end portion of the intermediate base block in a freely rotating manner;

a reclining movement mechanism for moving the backrest from a stationary position to a rearward tilted condition through rotation of the first link; and a rising movement mechanism for raising the seat surface of the reclining block from a stationary position to a specified height via the intermediate base block through rotation of the second link and the third link.

2. The chair for assisting rising movement as claimed in claim 1, wherein the second link and the third link are arranged to be of different lengths such that the rear end portion of the intermediate base block becomes higher than its front end portion at the time of rising movement.

3. The chair for assisting rising movement as claimed in claim 1, wherein a load applied to the second link and the third link at the time of rising movement is not reversed during rotation.

4. The chair for assisting rising movement as claimed in claim 2, wherein a load applied to the second link and the third link at the time of rising movement is not reversed during rotation.

5. The chair for assisting rising movement as claimed in claim 1, wherein the intermediate base block is provided with a receiving member mounted on the mount base block for maintaining the intermediate base block in the stationary position.

6. The chair for assisting rising movement as claimed in claim 1, wherein a footrest is connected in a freely rotating manner to a front end side of the seat surface of the reclining block, and the chair being provided with a control portion for enabling rising movement only when the footrest and the backrest are in stationary positions.

7. The chair for assisting rising movement as claimed in claim 6, wherein a control circuit box incorporating the control portion therein is mounted to the intermediate base block.

8. The chair for assisting rising movement as claimed in claim 6, wherein in case an operation for rising movement are directed when the backrest and the footrest are not in stationary positions, the control portion performs rising movement only after the backrest and the footrest have returned to their stationary positions.

9. The chair for assisting rising movement as claimed in claim 8, wherein a control circuit box incorporating the control portion therein is mounted to the intermediate base block.

10. The chair for assisting rising movement as claimed in claim 1, wherein the chair is provided with a mechanism of varying an angle of the seat surface at the time of reclining movement of the backrest.

11. The chair for assisting rising movement as claimed in claim 1, wherein a central side of the seat surface is supported by the intermediate base block in a freely rotating manner while a rear end portion of the seat surface is suspended from the backrest via a suspending link.

12. The chair for assisting rising movement as claimed in claim 1, wherein armrests are fixed to the seat surface such that their angles with respect to the seat surface are maintained to be constant.

13. The chair for assisting rising movement as claimed in claim 1, wherein the rising movement mechanism is comprised of an electric actuator for raising movement for rotating the second link and the third link, the electric actuator for raising movement being disposed to be substantially horizontal to the floor surface.

14. The chair for assisting rising movement as claimed in claim 1, wherein the chair is provided with an adaptor for adjusting a height of the seat surface with respect to the floor surface.

15. The chair for assisting rising movement as claimed in claim 1, wherein the chair is provided with a mechanism for reducing a height of the seat surface to be lower than that of the stationary position when performing a reclining movement of the backrest.

* * * * *